US011959490B2

(12) United States Patent
Botkin et al.

(10) Patent No.: US 11,959,490 B2
(45) Date of Patent: Apr. 16, 2024

(54) CEILING FAN WITH A BLADE CONNECTION ASSEMBLY

(71) Applicant: Hunter Fan Company, Memphis, TN (US)

(72) Inventors: Charles William Botkin, Cordova, TN (US); Bobby Neal Norwood, Oakland, TN (US)

(73) Assignee: Hunter Fan Company, Memphis, TN (US)

( * ) Notice: Subject to any disclaimer, the term of this patent is extended or adjusted under 35 U.S.C. 154(b) by 0 days.

(21) Appl. No.: 18/049,005

(22) Filed: Oct. 24, 2022

(65) Prior Publication Data

US 2023/0313813 A1 Oct. 5, 2023

Related U.S. Application Data

(60) Provisional application No. 63/324,987, filed on Mar. 29, 2022.

(51) Int. Cl.

| | |
|---|---|
| ***F04D 29/34*** | (2006.01) |
| ***F04D 19/00*** | (2006.01) |
| ***F04D 25/08*** | (2006.01) |
| ***F04D 29/32*** | (2006.01) |
| ***F04D 29/64*** | (2006.01) |

(52) U.S. Cl.

CPC ..... *F04D 29/34* (2013.01); *F04D 19/002* (2013.01); *F04D 25/088* (2013.01); *F04D 29/329* (2013.01); *F04D 29/646* (2013.01)

(58) Field of Classification Search

None

See application file for complete search history.

(56) References Cited

U.S. PATENT DOCUMENTS

| | | | | |
|---|---|---|---|---|
| 6,010,306 | A | 1/2000 | Bucher et al. | |
| 6,039,540 | A | 3/2000 | Wu | |
| 6,821,091 | B2 | 11/2004 | Lee | |
| 6,932,576 | B2 | 8/2005 | Bird | |
| 6,935,842 | B2 * | 8/2005 | Tai | F04D 29/34 416/206 |
| 7,527,478 | B2 | 5/2009 | Pearce | |
| 7,771,172 | B2 | 8/2010 | Wang | |
| 8,845,293 | B1 * | 9/2014 | Lowe | F04D 25/088 416/205 |
| 9,279,428 | B2 * | 3/2016 | Lowe | F04D 25/088 |
| 2005/0123403 | A1 * | 6/2005 | Tai | F04D 29/34 416/210 R |
| 2015/0078903 | A1 * | 3/2015 | Lowe | F04D 29/644 29/889.3 |

* cited by examiner

*Primary Examiner* — Juan G Flores
(74) *Attorney, Agent, or Firm* — McGarry Bair PC

(57) ABSTRACT

A ceiling fan or similar air-moving device can include a motor for rotating one or more blades to drive a volume of air about a space. A blade iron can couple the blades to the motor. A connection assembly provides for connecting the ceiling fan blade to the blade iron. The connection assembly provides for aligning the blade with a set of fingers and can slide from a first position to a second position to secure the blade to a blade iron.

14 Claims, 7 Drawing Sheets

CEILING FAN WITH A BLADE CONNECTION ASSEMBLY

CROSS-REFERENCE TO RELATED APPLICATION

This application claims benefit to U.S. Provisional Application No. 63/324,987, filed Mar. 29, 2022, of which is hereby incorporated herein by reference in its entirety.

FIELD OF INVENTION

This application is directed to a ceiling fan for moving a volume of air about a space, and more specifically, to a blade connection assembly for a ceiling fan.

BACKGROUND

Ceiling fans are machines traditionally suspended from a structure for moving a volume of air about an area. The ceiling fan includes a motor, with a rotor and stator, suspended from and electrically coupled to the structure. A set of blades mount to the rotor such that the blades are rotatably driven by the rotor, and can be provided at an angled orientation to move volume of air about the area.

BRIEF DESCRIPTION

In one aspect, the disclosure relates to a ceiling fan comprising: a motor, a blade including an upper surface and a lower surface, with a set of openings extending between the top surface and the bottom surface; a blade iron coupling the blade to the motor; and a connection assembly coupling the blade iron to the blade, the connection assembly comprising: at least one finger configured to insert into at least one opening of the set of openings, and a spring tab configured to insert into one opening of the set of openings, different than that of the finger, wherein the blade is between a first position and a second position relative to the connection assembly, wherein in the first position the at least one finger is inserted into at least some openings of the set of openings and the spring tab is unaligned with the set of openings, and wherein the second position the spring tab is aligned with and inserted into at least one opening of the set of openings.

In another aspect, the disclosure relates to a connection assembly for connecting a blade to a blade iron for a ceiling fan, the blade having a set of openings extending through the blade, the connection assembly comprising: a first portion including body extending between a first end and a second end, and including at least one finger to insert into at least some openings of the set of openings; and a second portion coupled to the first portion and including a spring tab to insert into the remaining openings of the set of openings.

In another aspect, the disclosure relates to a method of attaching a blade to a blade iron for a ceiling fan with a connection assembly, the method comprising: positioning the blade against the blade iron to position a set of fingers on the connection assembly within a set of openings in the blade at a first position; and sliding the blade along the blade iron into a second position.

DETAILED DESCRIPTION

Figure 1:
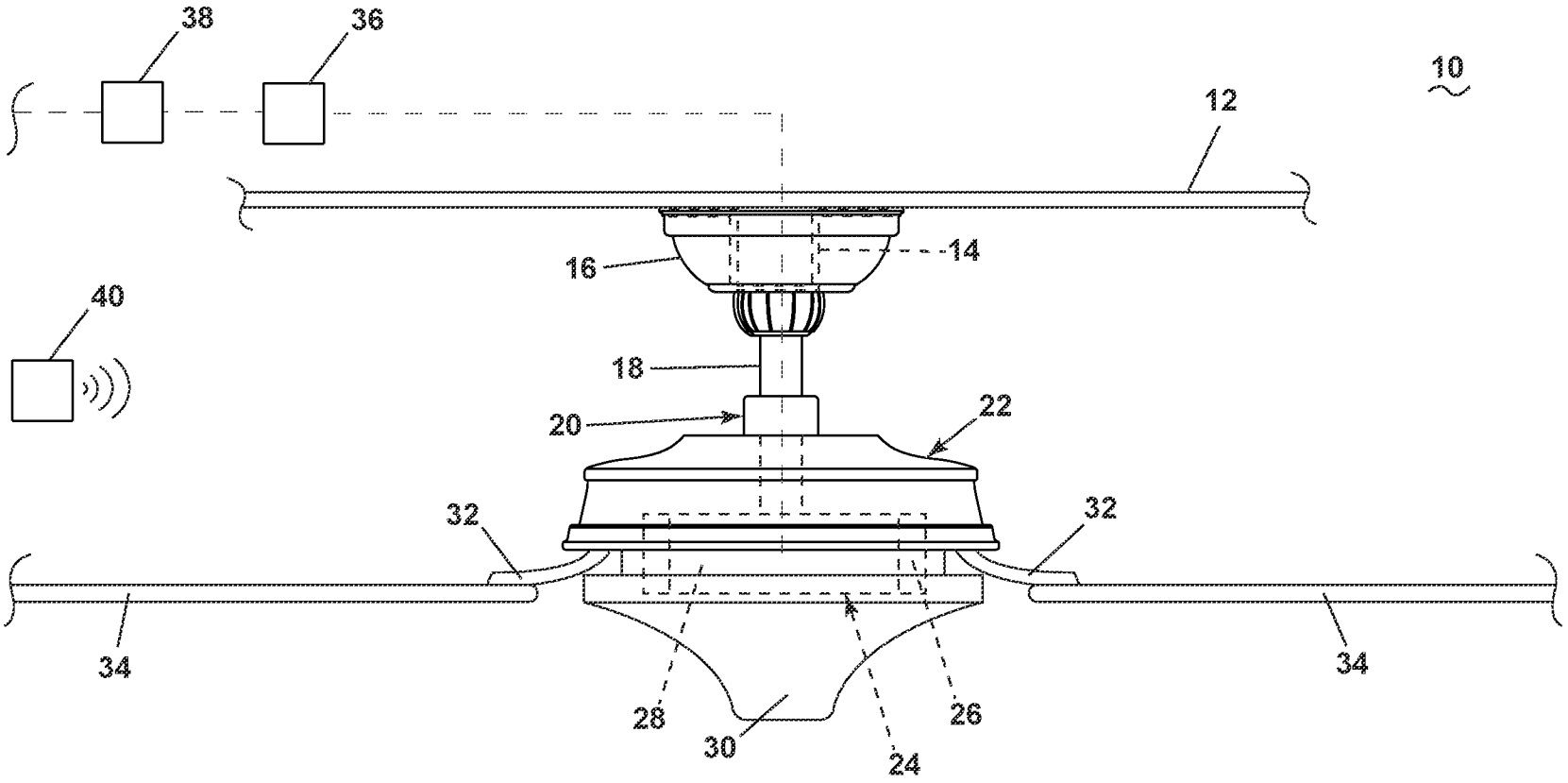
FIG. 1 is a schematic view of a structure with a ceiling fan suspended from a structure and in accordance with aspects described herein.

The disclosure is related to a ceiling fan and ceiling fan blade attachment system, which can be used, for example, in residential and commercial applications. Such applications can be indoors, outdoors, or both. While this description is primarily directed toward a residential ceiling fan, it is also applicable to any environment utilizing fans or for cooling areas utilizing air movement.

As used herein, the term "set" or a "set" of elements can be any number of elements, including only one. All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, connected, and joined) are to be construed broadly and can include intermediate members between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary.

Referring now to FIG. 1, a ceiling fan 10 is suspended from a structure 12. In non-limiting examples, the ceiling fan 10 can include one or more ceiling fan components including a hanger bracket 14, canopy 16, a downrod 18, a motor adapter 20, a motor housing 22 at least partially encasing a motor 24 having a rotor 26 and a stator 28, a light kit 30, and a set of blade irons 32. In additional non-limiting examples, the ceiling fan 10 can include one or more of a controller, a wireless receiver, a ball mount, a hanger ball, a light glass, a light cage, a spindle, a finial, a switch housing, blade forks, blade tips or blade caps, or other ceiling fan components. A set of blades 34 can extend radially from the ceiling fan 10, and can be rotatable to drive a volume of fluid such as air. The blades 34 can be operably coupled to the motor 24 at the rotor 26, such as via the blade irons 32. The blades 34 can include a set of blades 34, having any number of blades, including only one blade.

The structure 12 can be a ceiling, for example, from which the ceiling fan 10 is suspended. It should be understood that the structure 12 is schematically shown and is by way of example only, and can include any suitable building, structure, home, business, or other environment wherein moving air with a ceiling fan is suitable or desirable. The structure 12 can also include an electrical supply 36 can be provided in the structure 12, and can electrically couple to the ceiling fan 10 to provide electrical power to the ceiling fan 10 and the motor 24 therein. It is also contemplated that the electrical supply be sourced from somewhere other than the structure 12, such as a battery or generator in non-limiting examples.

A controller 38 can be electrically coupled to the electrical supply 36 to control operation of the ceiling fan 10 via the electrical supply 36. Alternatively, the controller 38 can be wirelessly or communicatively coupled to the ceiling fan 10, configured to control operation of the ceiling fan 10 remotely, without a dedicated connection. Non-limiting examples of controls for the ceiling fan 10 can include fan speed, fan direction, or light operation. Furthermore, a separate wireless controller 40, alone or in addition to the wired controller 38, can be communicatively coupled to a controller or a wireless receiver in the ceiling fan 10 to control operation of the ceiling fan 10. It is further contemplated in one alternative example that the ceiling fan be operated by the wireless controller 40 alone, and is not operably coupled with the wired controller 38.

Figure 2:
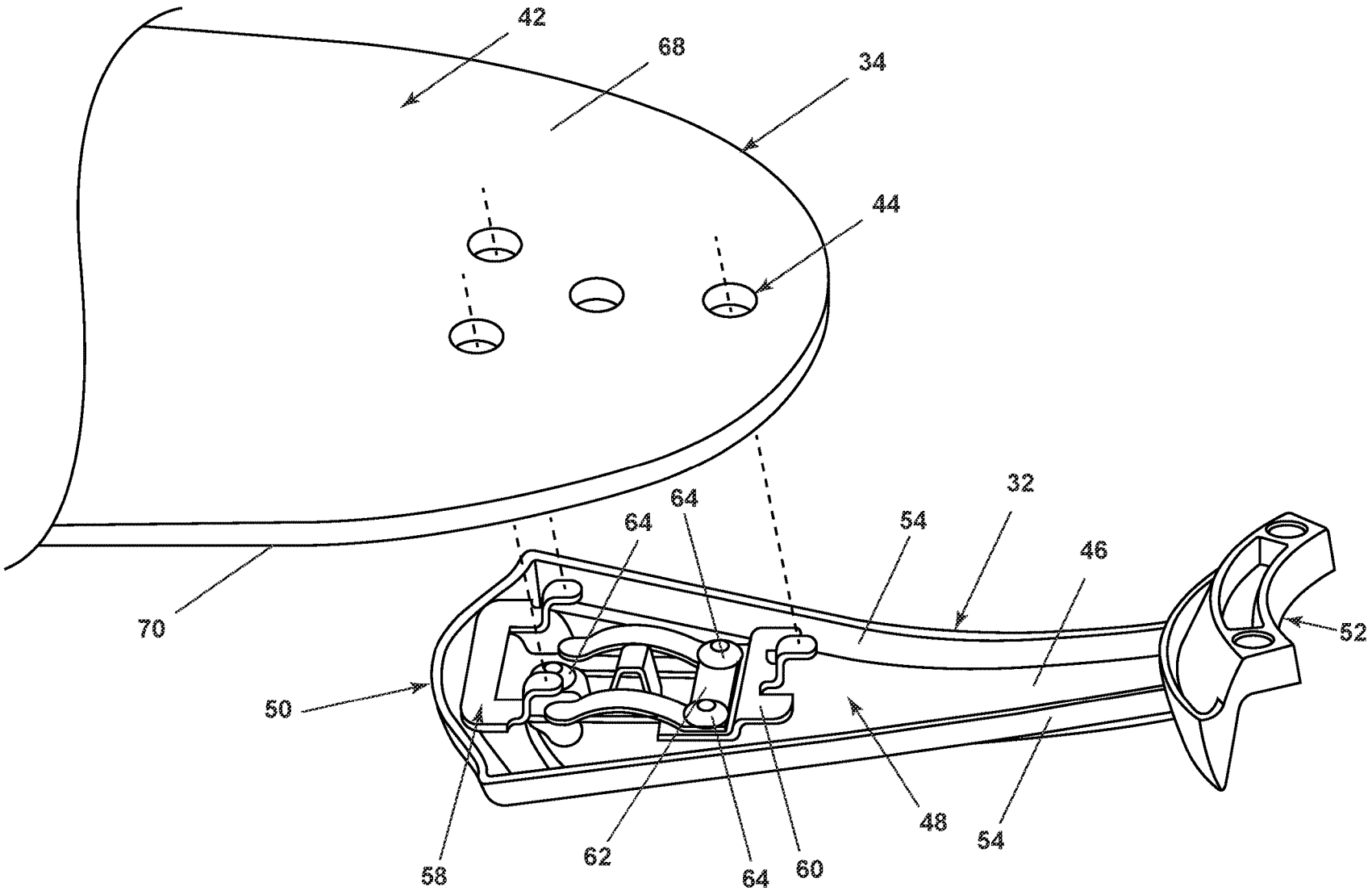
FIG. 2 is an exploded view of a blade and blade iron for the ceiling fan of FIG. 1, showing a connection assembly for connecting the blade to the blade iron in accordance with aspects described herein.

Referring now to FIG. 2, one blade 34 is provided exploded from one blade iron 32. The blade 34 includes a body 42 having a set of openings 44 provided in the body 42. The body includes an upper surface 68 and a lower surface 70, with the set of openings 44 extending between the upper surface 68 and the lower surface 70. The blade iron 32 includes a blade iron body 46 at least partially defining an interior 48. The blade iron body 46 extends between a proximal end 50 configured to adjoin to the blade 34, and a distal end 52 configured to mount to the motor 24 of FIG. 1, with sides 54 extending between the proximal and distal ends 50, 52.

A connection assembly 58 is provided, and can be at least partially within the interior 48, and mounted to the blade iron body 46. The connection assembly 58 includes a first portion 60 and a second portion 62. The first portion 60 can be mounted to the blade iron body 46 within the interior 48, and the second portion 62 can be mounted to the first portion 60. A set of fasteners 64 can be used to secure the first portion 60 and the second portion 62 to the blade iron body 46.

Figure 3:
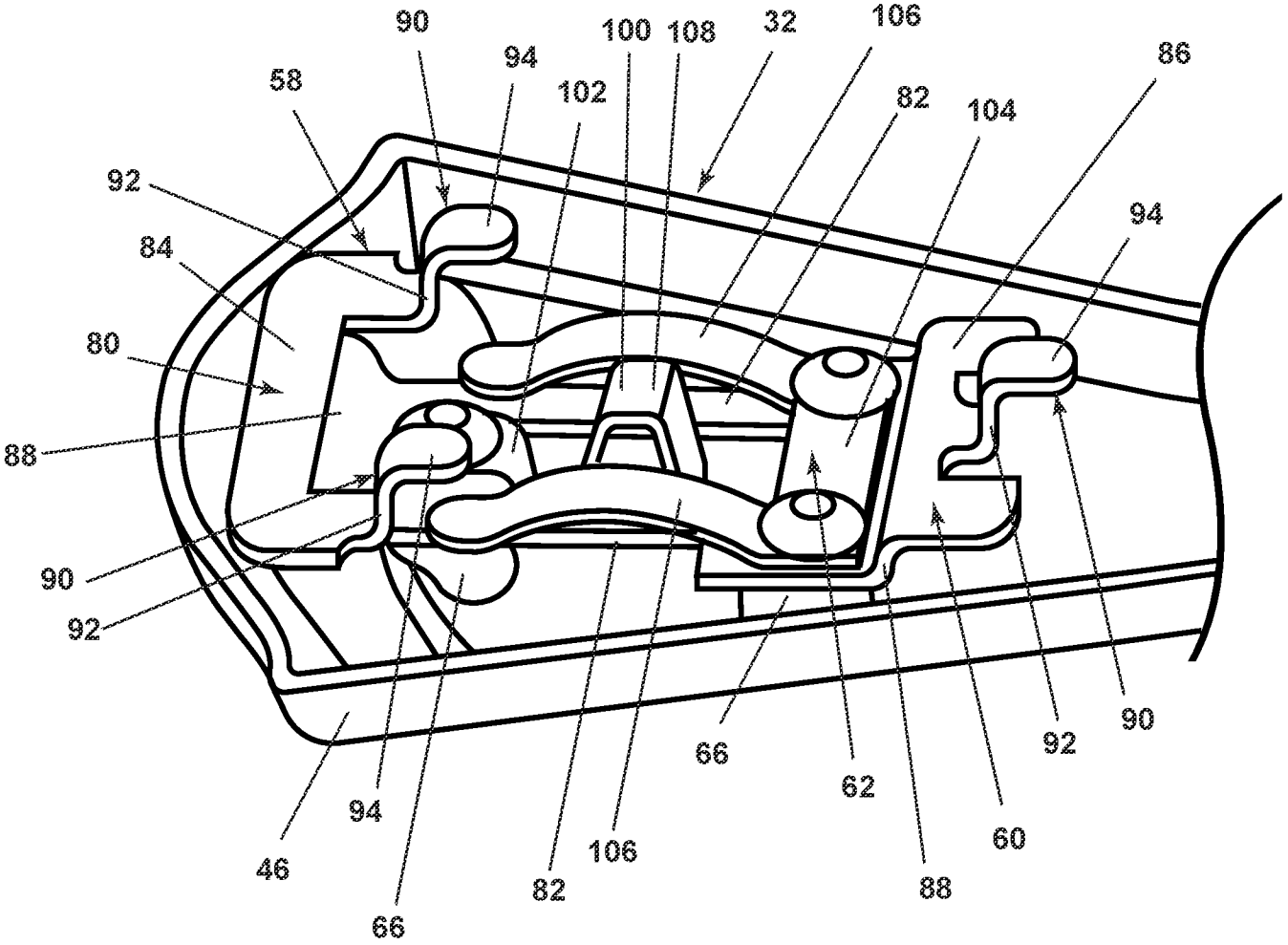
FIG. 3 is an enlarged view of the connection assembly of FIG. 2.

Turning to FIG. 3, the blade iron body 46 can include a set of posts 66, or other suitable receptacles, configured to receive the fasteners 64 to mount the first portion 60 and the second portion 62 to the blade iron 32. The first portion 60 includes a body 80 including a pair of ribs 82 extending between and spacing a first end 84 and a second end 86. The first end 84 and the second end 86 can each join to the ribs 82 at a curved junction 88, which can provide for raising the first end 84 and the second end 86 from the blade iron body 46. The first end 84 includes a pair of fingers 90 and the second end includes one finger 90, while any number of fingers 90 on either of the first end 84 or the second end 86 is contemplated. Each finger 90 includes an elongation 92 extending in a direction similar to that of the curved junctions 88 away from the blade iron body 46. A tip 94 extends from each elongation 92 in a direction toward the distal end 52.

The second portion 62 includes a body 100 extending between a first end 102 and a second end 104. The first end 102 can secure to the first portion 60 near the first end 84 prior to the curved junction 88. The second end 104 secures to the first portion 60 near the second end 86 prior to the curved junction 88. Fasteners 64 pass through the first and second ends 102, 104, through the first portion 60, and secures both the first portion 60 and the second portion 62 to the blade iron 32. A pair of spring members 106 extend from the second end 104 where the fasteners 64 attach to the second end 104. A spring tab 108 is formed by a serpentine geometry for the body 100, positioned between the first end 102 and the second end 104.

Figure 4:
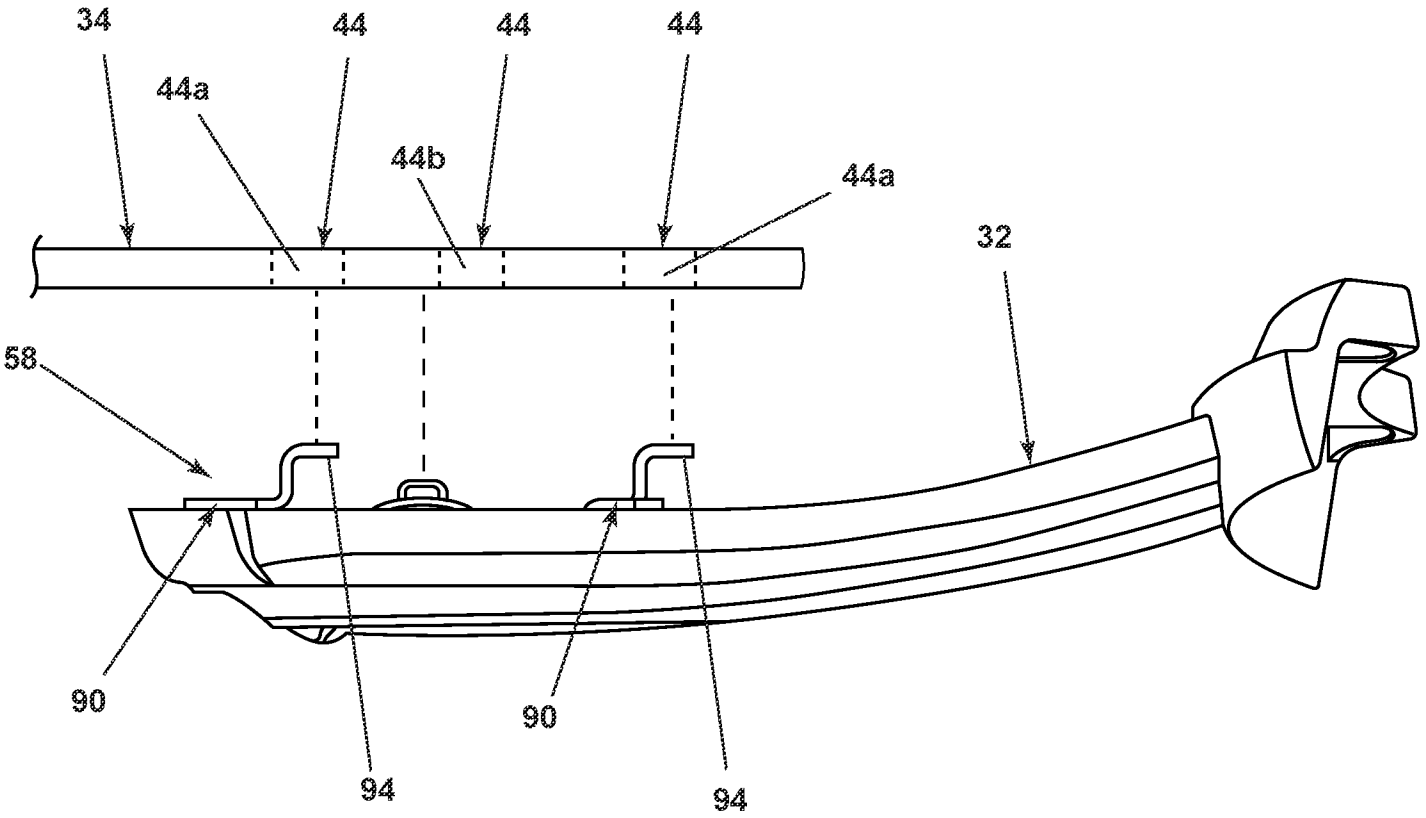
FIG. 4 is side view showing the blade exploded from the blade iron of FIG. 2, illustrating attachment of the blade via the blade connection assembly of FIG. 2.

Referring now to FIG. 4, one can appreciate that the tips 94 are arranged complementary to the openings 44, such that attachment of the blade 34 to the blade iron 32 is secured by the connection assembly 58. At least some of the openings 44 can be finger openings **44*a*, configured to receive the fingers 90. The blade 34 is aligned with the blade iron 32 such the finger openings 44*a* are aligned with the tips 94. The spring tab 108 is slightly unaligned with one of the openings 44, which can be a tab opening 44*b*, where such misalignment accounts for the extension of the tips 94 of the fingers 90. Similarly, it can be appreciated that the spring tab 108 extends above the blade iron body 46**.

Figure 5:
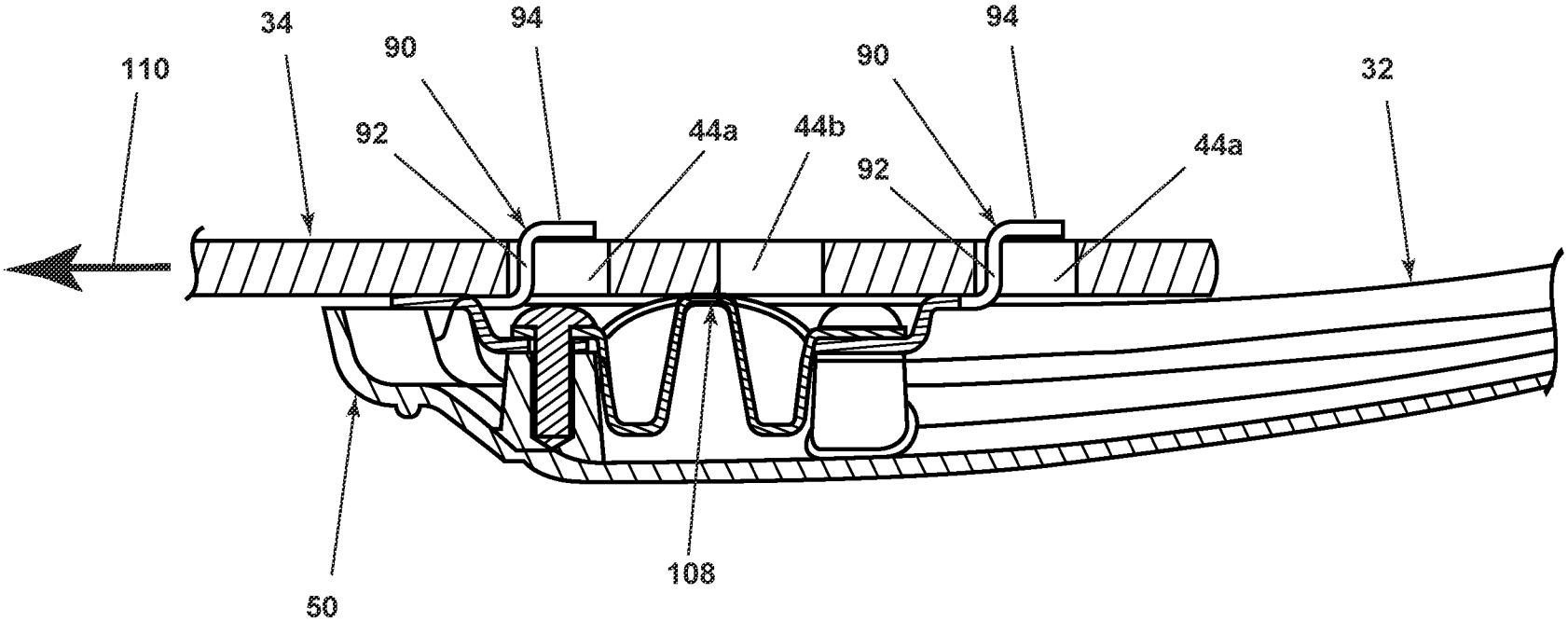
FIG. 5 shows a section view with the blade aligned along the blade iron in a first position.

Referring to FIG. 5, the blade 34 has been positioned in a first position adjacent to the blade iron 32, with the fingers 90 inserted into the finger openings **44*a*. As can be appreciated, the elongation 92 is positioned nearer to one side of the finger openings 44*a*, permitting room for the tip 94 to pass through the finger openings 44*a*. The spring tab 108 is compressed inward within the interior 48 by the blade 34, to permit the tips 94 to extend through the finger openings 44*a*. As can be appreciated, the inward compression of the spring tab 108 is permitted by the serpentine geometry for the second portion 62 of the connection assembly 58, and such inward compression permits the tips 94 to extend through the finger openings 44*a***.

Figure 6:
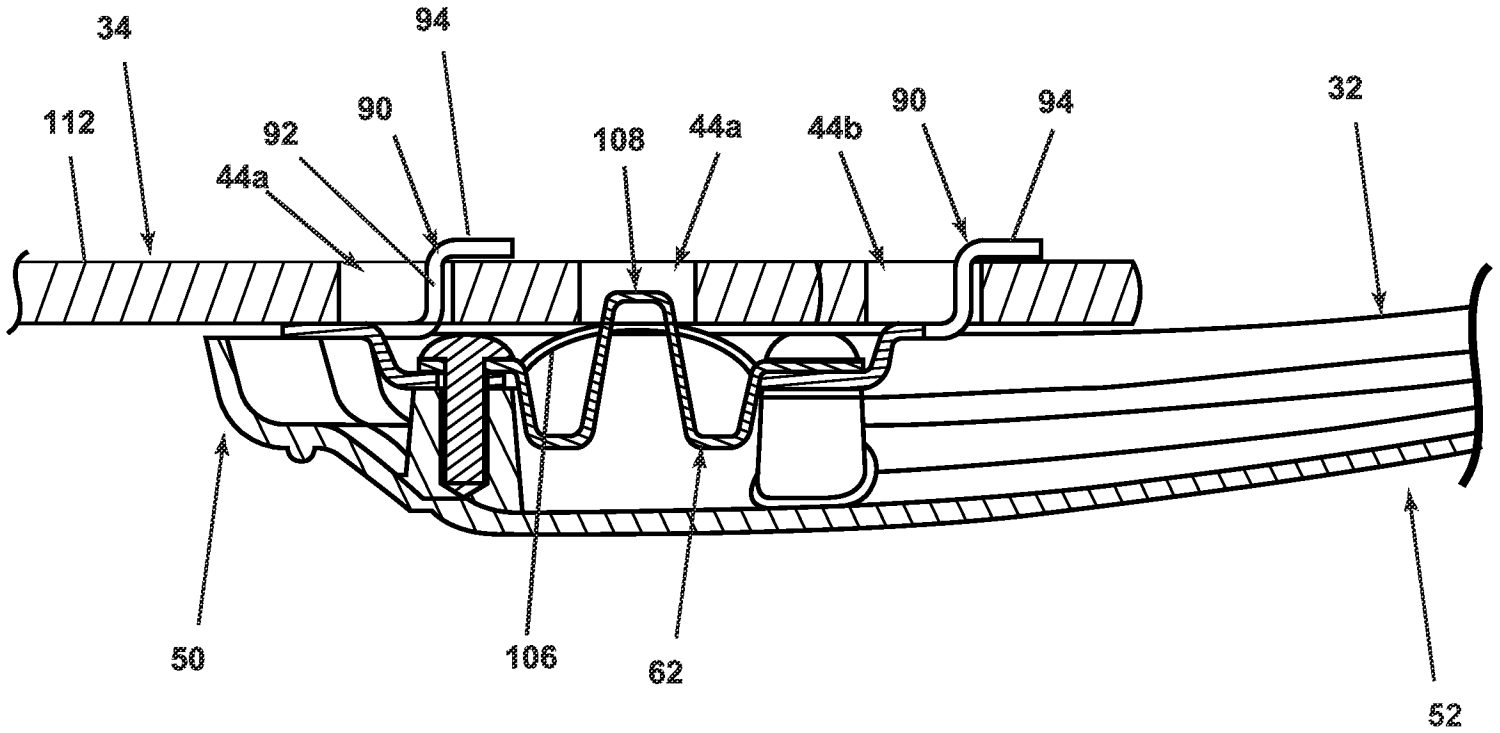
FIG. 6 shows a section view with the blade secured to the blade iron in a second position.

After insertion of the tips 94 into the finger openings **44*a*, the blade 34 can be slid in a direction toward the proximal end 50 of the blade iron 32, shown by arrow 110. It should be understood that alternatively, the blade iron 32 can be slid relative to the blade 34, in a direction opposite of the arrow 110. In this way, either of the blade 34 or the blade iron 32 can be slide relative to the other of the blade 34 or blade iron 32 to secure the two together. Referring to FIG. 6, showing the blade 34 in a second position, the spring tab 108 positions within the tab opening 44*b* in the blade 34, as the sliding movement from the first position to the second position aligns the spring tab 108 with the tab opening 44*b*. The serpentine structure of the spring tab 108 permits flexion of the spring tab 108 in the first position (FIG. 5), and permits the spring tab 108 to return to its original position when the blade 34 is in the second position in FIG. 6. Additionally, in the first position, the spring members 106 are slightly compressed against and confronting the lower surface 68 of the blade 34**.

In the second position, the tips 94 secure the position of the blade 34 relative to the blade iron 32, as movement from the first position to the second position permits the tips 94 to position along the upper surface 68 of the blade 34. The spring members 106 confront the blade 34 to provide a spring force in an upward direction, such that the blade 34 is pushed against the tips 94, securing the vertical movement of the blade 34, which secures the spring tab 108 within the tab opening **44*b*. Similarly, the spring tab 108, as well as the fingers 90, prevents radial movement of the blade 34 during operation of the ceiling fan. The arrangement of the tip 94 extending toward the distal end 52 of the blade iron 32 forms a hook, such that rotation of the ceiling fan and the blade 34 secures the blade 34 to the blade iron 32 via the rotational momentum during rotation of the blade 34**.

In operation, a user aligns the blade 34 with the blade iron 32 as shown in FIG. 2. The blade 34 can be pressed against the blade iron 32, with alignment of the two guided by accepting insertion of the fingers 90 into the openings 44. The user presses the blade 34 against the blade iron 32, such that spring tab 108 and the spring members 106 are pushed and bent into further into the interior 48. The user slides the blade 34 toward the proximal end 50 of the blade iron 32, and permits room for the spring tab 108 to return to its initial position, inserted within the tab opening 44*b*. Such a return to the initial position also results in a 'snap', providing either or both of audible and haptic feedback, which indicates to the user that the blade 34 has been secured to the blade iron 32. Similarly, the visual representation of the tip 94 positioned over the upper surface 68 of the blade 34 indicates to the user that the blade 34 is secured to the blade iron 32. To remove the blade 34 from the blade iron 32, the user can depress the spring tab 108 and slide the blade 34 from the second position back to the first position (FIG. 5), and remove the blade 34 from the fingers 90.

Figure 7:
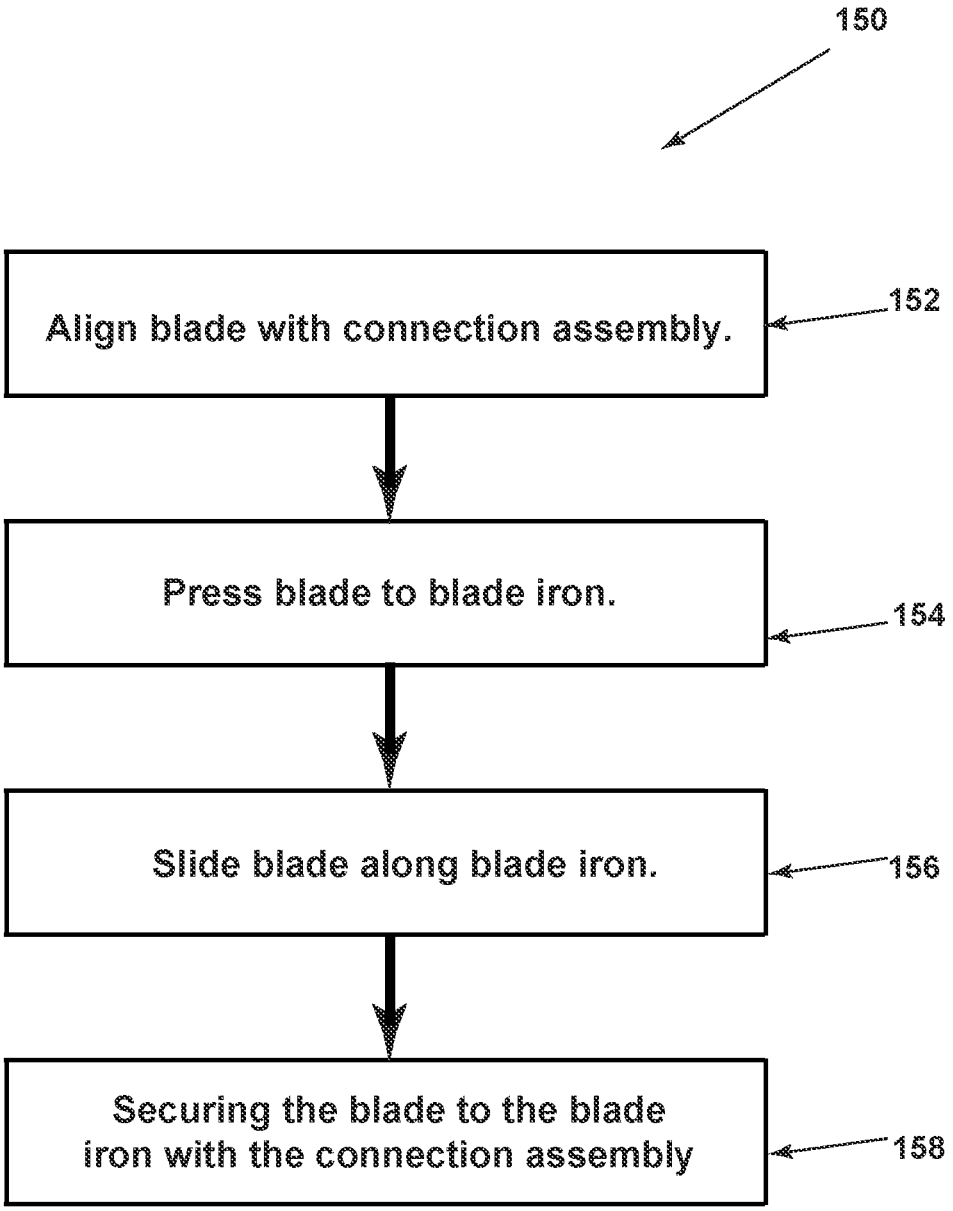
FIG. 7 shows a flow chart showing a method of connecting a blade to a blade iron with the connection assembly of FIG. 2.

Referring to FIG. 7, a method 150 of attaching a blade 34 to a blade iron 32 can be appreciated. At 152, a user can visually align a blade 34 with a connection assembly 58 by visually aligning the finger openings 44*a* of the blade 34 with the fingers 90. At 154, the blade 34 can be pressed against the blade iron 32 by a user. The user can visually identify that the fingers 90 have extended through the finger openings 44*a*, as well as receiving tactile feedback from compression of the spring tab 108 and the spring members 106. Additionally, the tip 94 can indicate to a user a direction to slide the blade 34, relative to the blade iron 32, such that the tips 94 will be secured against the upper surface 68 of the blade 34.

At 156, the blade 34 can be slid toward the proximal end 50 of the blade iron 32 (or optionally, the blade iron 32 can be slid away from the blade 34 in a direction toward the distal end 52 of the blade iron 32). The sliding of the blade 34 positions the spring tab 108 within the tab opening 44*b* in the blade 34, and can generate an audible and tactile 'click' or 'snap' when the spring tab 108 inserts into the tab opening 44*b*. At 158, the connection assembly 58 can secure the blade 34 to the blade iron 32. Additionally, the tips 94 of the fingers 90 extend along the upper surface 68 of the blade to secure the blade 34 against the blade iron 32. In this way, the spring tab 108 secures the position of the blade 34 in the radial direction, relative to rotation of the blade 34, while the tip 94 of the finger 90 secures the blade in the vertical direction, effectively securing the blade 34 to the blade iron 32.

The connection assembly and elements thereof as described herein provide for easy and simple connection of a ceiling fan blade to a ceiling fan blade iron. The connection assembly facilitates installation of the ceiling fan, by facilitating installation of the blade to the blade irons, as well as providing visual, audible, and tactile feedback to a user to indicate assembly. Furthermore, the connection assembly can provide for reduced vibrational noise, resultant of the spring compression of the spring members 106. Additionally, the spring members provide to secure the blade against the tips of the fingers, as well as reduce vibration among the blade and blade iron.

To the extent not already described, the different features and structures of the various features can be used in combination as desired. That one feature is not illustrated in all of the aspects of the disclosure is not meant to be construed that it cannot be, but is done for brevity of description. Thus, the various features of the different aspects described herein can be mixed and matched as desired to form new features or aspects thereof, whether or not the new aspects or features are expressly described. All combinations or permutations of features described herein are covered by this disclosure.

This written description uses examples to detail the aspects described herein, including the best mode, and to enable any person skilled in the art to practice the aspects described herein, including making and using any devices or systems and performing any incorporated methods. The patentable scope of the aspects described herein are defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A ceiling fan comprising:

a motor, a blade including an upper surface and a lower surface, with a set of openings extending between the upper surface and the lower surface;

a blade iron coupling the blade to the motor; and a connection assembly coupling the blade iron to the blade, the connection assembly comprising:

at least one finger configured to insert into a first opening of the set of openings, a spring tab configured to insert into a second opening of the set of openings, different than the first opening, and a spring member, wherein the blade is movable between a first position and a second position relative to the connection assembly, wherein in the first position the at least one finger is inserted into the first opening, the spring member applies a biasing force against one of the upper surface or lower surface, and the spring tab is unaligned with the second opening, and wherein in the second position the spring tab is aligned with and inserted into the second opening, and the at least one finger is drawn against the other of the upper surface or lower surface by the biasing force.

2. The ceiling fan of claim 1 wherein the set of openings are arranged into a set of finger openings and a tab opening.

3. The ceiling fan of claim 2 wherein the at least one finger is provided as a set of fingers, and the set of finger openings is complementary to the set of fingers.

4. The ceiling fan of claim 1 wherein the at least one finger includes a tip positioned over the upper surface of the blade when the blade is in the second position.

5. The ceiling fan of claim 4 wherein the at least one finger further includes an elongation extending through the first opening of the set of openings and connecting to the tip.

6. The ceiling fan of claim 1 wherein the spring member confronts the blade in both the first position and the second position.

7. The ceiling fan of claim 1 wherein the connection assembly further comprises a first portion and a second portion separate from the first portion.

8. The ceiling fan of claim 7 wherein the at least one finger is provided on the first portion.

9. The ceiling fan of claim 8 wherein the spring tab is provided on the second portion.

10. The ceiling fan of claim 7 wherein the first portion couples to the blade iron and the second portion couples to the first portion.

11. A connection assembly for connecting a blade to a blade iron for a ceiling fan, the blade having a set of openings extending through the blade, the connection assembly comprising:

a first portion including a body extending between a first end and a second end, and including at least one finger to insert into at least some openings of the set of openings; and a second portion coupled to the first portion and including a spring tab to insert into the remaining openings of the set of openings;

wherein the first portion includes a pair of ribs extending between the first end and the second end.

12. The connection assembly of claim 11 wherein the spring tab is arranged between the pair of ribs.

13. The connection assembly of claim 12 further comprising a curved junction provided between the ribs and the first end, and a second curved junction provided between the ribs and the second end.

14. The connection assembly of claim 11 wherein the second portion further includes a pair of spring members with the spring tab positioned between the pair of spring members.

* * * * *